US008828148B2

(12) United States Patent
Poyner et al.

(10) Patent No.: US 8,828,148 B2
(45) Date of Patent: Sep. 9, 2014

(54) DISHWASHER WITH ACCESSIBLE CONTROL UNIT, AND ASSOCIATED METHOD

(75) Inventors: Dennis A. Poyner, Kinston, NC (US); Jerry Olesen, Kinston, NC (US); John Helgesen, Rock Hill, SC (US); Gregory A. Meyer, Batesville, IN (US)

(73) Assignee: Electrolux Home Products, Inc., Charlotte, NC (US)

( * ) Notice: Subject to any disclaimer, the term of this patent is extended or adjusted under 35 U.S.C. 154(b) by 975 days.

(21) Appl. No.: 11/972,936

(22) Filed: Jan. 11, 2008

(65) Prior Publication Data

US 2008/0196751 A1 Aug. 21, 2008

Related U.S. Application Data

(60) Provisional application No. 60/888,478, filed on Feb. 6, 2007.

(51) Int. Cl.
*B08B 3/00* (2006.01)

(52) U.S. Cl.
USPC ..... 134/56 D; 134/57 D

(58) Field of Classification Search
None
See application file for complete search history.

(56) References Cited

U.S. PATENT DOCUMENTS

| | | | | |
|---|---|---|---|---|
| 2,678,051 | A | 5/1954 | Stoddard | |
| 3,936,107 | A | 2/1976 | Gourdeau et al. | |
| 3,967,164 | A | 6/1976 | Valle | |
| 4,250,865 | A | 2/1981 | Scherer | |
| 4,942,630 | A | 7/1990 | Kantor et al. | |
| 5,039,828 | A | 8/1991 | Marks et al. | |
| 5,257,171 | A | 10/1993 | Hara | |
| 5,584,563 | A | 12/1996 | Stottmann | |
| 5,609,172 | A | 3/1997 | Chang et al. | |
| 5,718,007 | A | 2/1998 | Loyd | |
| 6,390,518 | B1 | 5/2002 | Elick | |
| 6,719,383 | B2 | 4/2004 | Elick et al. | |
| 6,791,288 | B2 | 9/2004 | Peterson et al. | |
| 2002/0014260 | A1 | 2/2002 | Kim et al. | |
| 2002/0074026 | A1 | 6/2002 | Kim et al. | |
| 2003/0127954 | A1 * | 7/2003 | Elick et al. | 312/228 |
| 2004/0156170 | A1 * | 8/2004 | Mager et al. | 361/683 |

(Continued)

FOREIGN PATENT DOCUMENTS

| | | |
|---|---|---|
| DE | 70 05 889 U | 6/1970 |
| DE | 73 36 418 U | 1/1974 |

(Continued)

OTHER PUBLICATIONS

Office Action for Russian Patent Application No. 2009128174, dated Sep. 14, 2011.

Elements of the Microwave Furnace; [Online]; [Retrieved on Dec. 5, 2011]; Retrieved from the Internet <URL: http://www.elremont.ru/small_rbt/bt_rem24.php>.

(Continued)

*Primary Examiner* — Jason Ko
(74) *Attorney, Agent, or Firm* — Alston & Bird LLP

(57) ABSTRACT

A dishwasher is provided, comprising a base portion adapted to support a tub portion. A control unit is configured to be in communication with at least one dishwasher operational component and with at least one control switch device remotely disposed with respect to the base portion. The control unit is responsive to the at least one control switch device to control the at least one dishwasher operational component. The control unit is disposed about the base portion and is selectively accessible from a forward side thereof. An associated method is also provided.

20 Claims, 9 Drawing Sheets

(56) References Cited

U.S. PATENT DOCUMENTS

| | | | |
|---|---|---|---|
| 2005/0155394 | A1 | 7/2005 | Brauchle |
| 2005/0210926 | A1 | 9/2005 | Kwon et al. |
| 2006/0114128 | A1 | 6/2006 | Prinz et al. |
| 2006/0218828 | A1 | 10/2006 | Schrimpf et al. |

FOREIGN PATENT DOCUMENTS

| | | | |
|---|---|---|---|
| DE | 92 07 677 | U1 | 8/1992 |
| DE | 43 16 858 | A1 | 11/1993 |
| DE | 102 42 678 | A1 | 4/2004 |
| EP | 0 243 632 | A | 11/1987 |
| EP | 0 388 375 | A3 | 9/1990 |
| EP | 0 695 825 | A | 2/1996 |
| EP | 0 752 231 | A | 1/1997 |
| EP | 0 855 165 | A | 7/1998 |
| EP | 1 530 942 | A1 | 5/2005 |
| EP | 1 545 177 | A1 | 6/2005 |
| GB | 2 256 580 | A | 12/1992 |
| GB | 2 381 442 | A | 5/2003 |
| JP | 4-261633 | A | 9/1992 |
| JP | 10-211155 | A | 8/1998 |
| JP | 2996751 | B2 | 1/2000 |
| JP | 2005118283 | A | 5/2005 |
| WO | WO 2004/096005 | A | 11/2004 |

OTHER PUBLICATIONS

Office Action and Search Report for Chinese Application No. 200880004222.3 dated Feb. 16, 2013.
Office Action for Japanese Application No. 10-2009-7017304 dated Dec. 16, 2013.
International Search Report and Written Opinion for Application No. PCT/US2008/052895 dated Jul. 15, 2008.
Office Action for Chinese Application No. 200880004222.3 dated Jul. 26, 2012.
Office Action for Chinese Application No. 200880004222.3 dated Feb. 28, 2012.
Office Action for Chinese Application No. 200880004222.3 dated Sep. 14, 2010.
Office Action for Canadian Application No. 2,675,673 dated Feb. 4, 2014.
Office Action for Russian Application No. 2009128174/12 dated Apr. 14, 2011.
Decision to Grant for Russian Application No. 2009128174/12 dated Feb. 16, 2012.
Office Action for Australian Application No. 2008213965 dated Aug. 1, 2012.
Notice of Acceptance for Australian Application No. 2008213965 dated Sep. 13, 2013.

* cited by examiner

DISHWASHER WITH ACCESSIBLE CONTROL UNIT, AND ASSOCIATED METHOD

CROSS-REFERENCE TO RELATED APPLICATIONS

This application claims the benefit of U.S. Provisional Application No. 60/888,478, filed Feb. 6, 2007, the contents of which are incorporated herein by reference.

BACKGROUND OF THE INVENTION

1. Field of the Invention

Embodiments of the present invention relate to dishwashers and, more particularly, to a dishwasher having an accessible control unit, and a method associated therewith.

2. Description of Related Art

Typically, when installing a dishwasher in an under-counter cabinet, the electrical supply from the house wiring to the dishwasher is first attached to the designated terminals of the dishwasher (usually disposed within the dishwasher base) before the dishwasher is installed in the cabinet. The electrical power is then directed through the terminals to the electronic control unit (ECU) of the dishwasher, wherein the ECU may be mounted within the base in conjunction with the terminals, or in the door assembly of the dishwasher. As such, it may only be possible to gain access to the terminals of the ECU only when the dishwasher is removed from the cabinet. Further, disassembly of the dishwasher may be necessary if access to the ECU is required for service, diagnostics, and/or replacement. Thus, the dishwasher must often be removed from the cabinet for connecting/disconnecting electrical power, and extensive disassembly/assembly of the dishwasher may be required to access the ECU. Accordingly, a dishwasher having improved access to the ECU thereof would be desirable.

BRIEF SUMMARY OF THE INVENTION

The above and other needs are met by the present invention which, in one embodiment, provides a dishwasher, comprising a base portion adapted to support a tub portion. A control unit is configured to be in communication with at least one dishwasher operational component and with at least one control switch device remotely disposed with respect to the base portion. The control unit is responsive to the at least one control switch device to control the at least one dishwasher operational component. The control unit is disposed about the base portion and is selectively accessible from a forward side thereof.

Another aspect of the present invention comprises a method of forming a dishwasher. Such a method comprises disposing a control unit about a base portion of the dishwasher, wherein the base portion is adapted to support a tub portion, such that the control unit is selectively accessible from a forward side of the base portion. The control unit is configured to be in communication with at least one dishwasher operational component and with at least one control switch device remotely disposed with respect to the base portion, such that the control unit is responsive to the at least one control switch device to control the at least one dishwasher operational component.

Aspects of the present invention thus provide significant advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1 schematically illustrates an exploded perspective view of a dishwasher device having an accessible control unit according to one embodiment of the present invention;

FIG. 2A schematically illustrates a perspective view of a dishwasher device having an accessible control unit pivotably mounted to a base portion thereof, with the control unit in an open accessible position, according to the embodiment of the present invention shown in FIG. 1;

Figure 4:
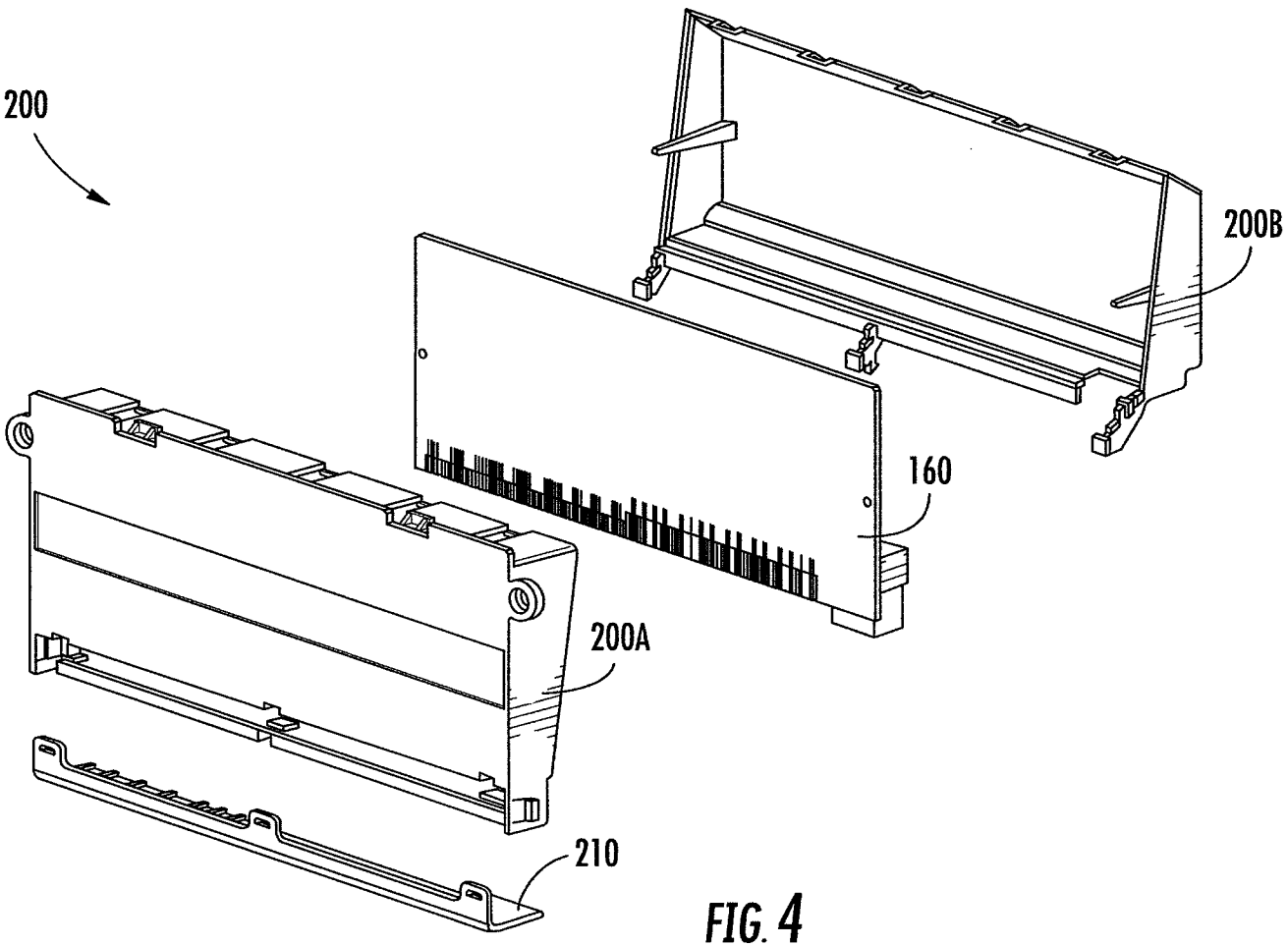
Figure 5B:
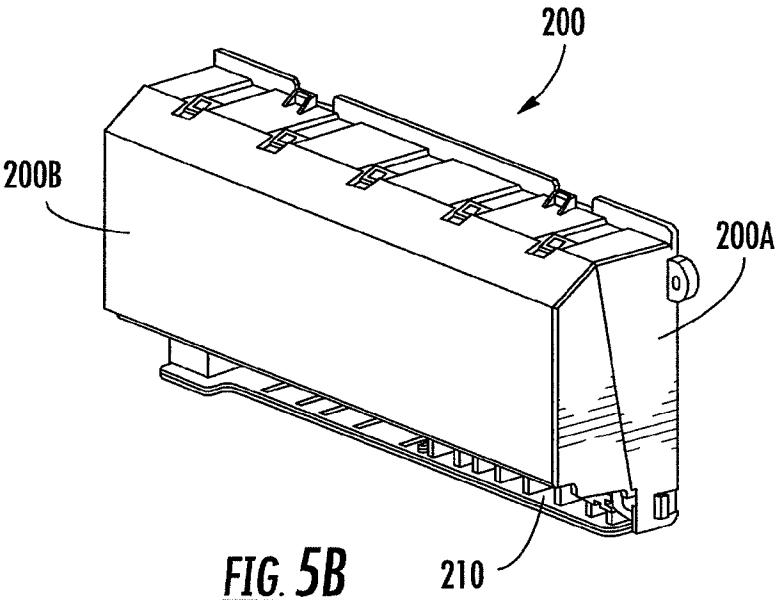
Figure 5A:
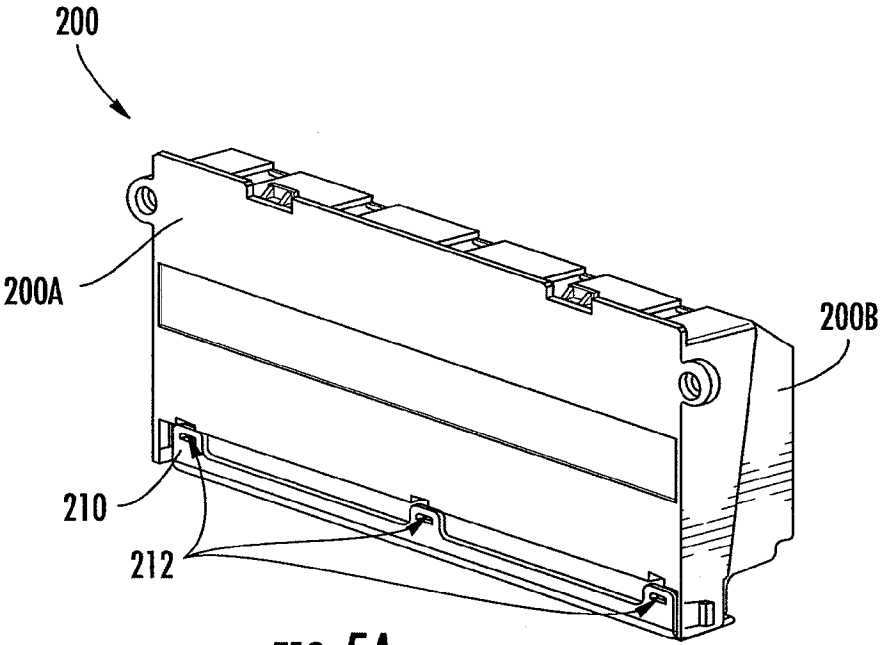
Figure 6:
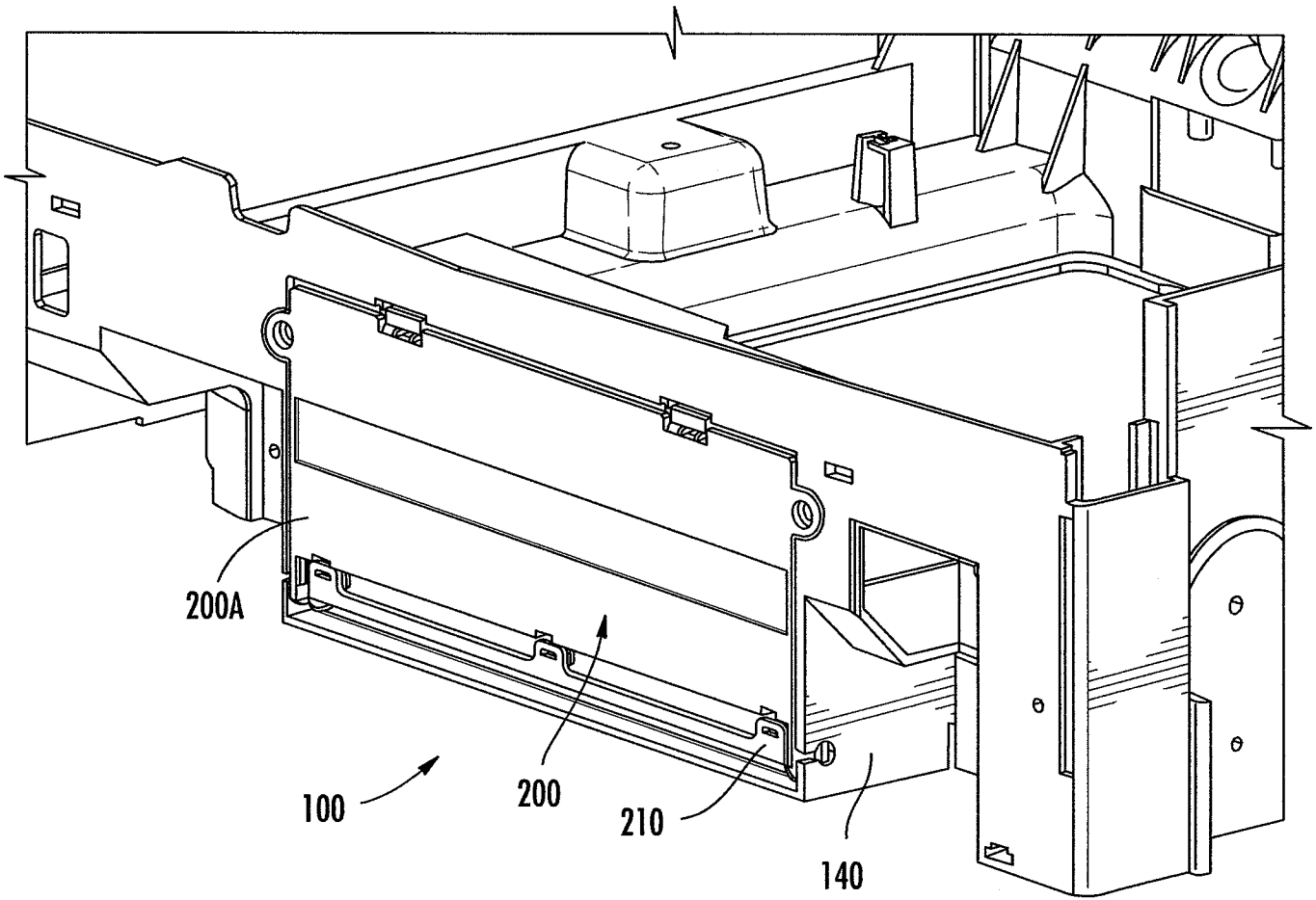
Figure 7:
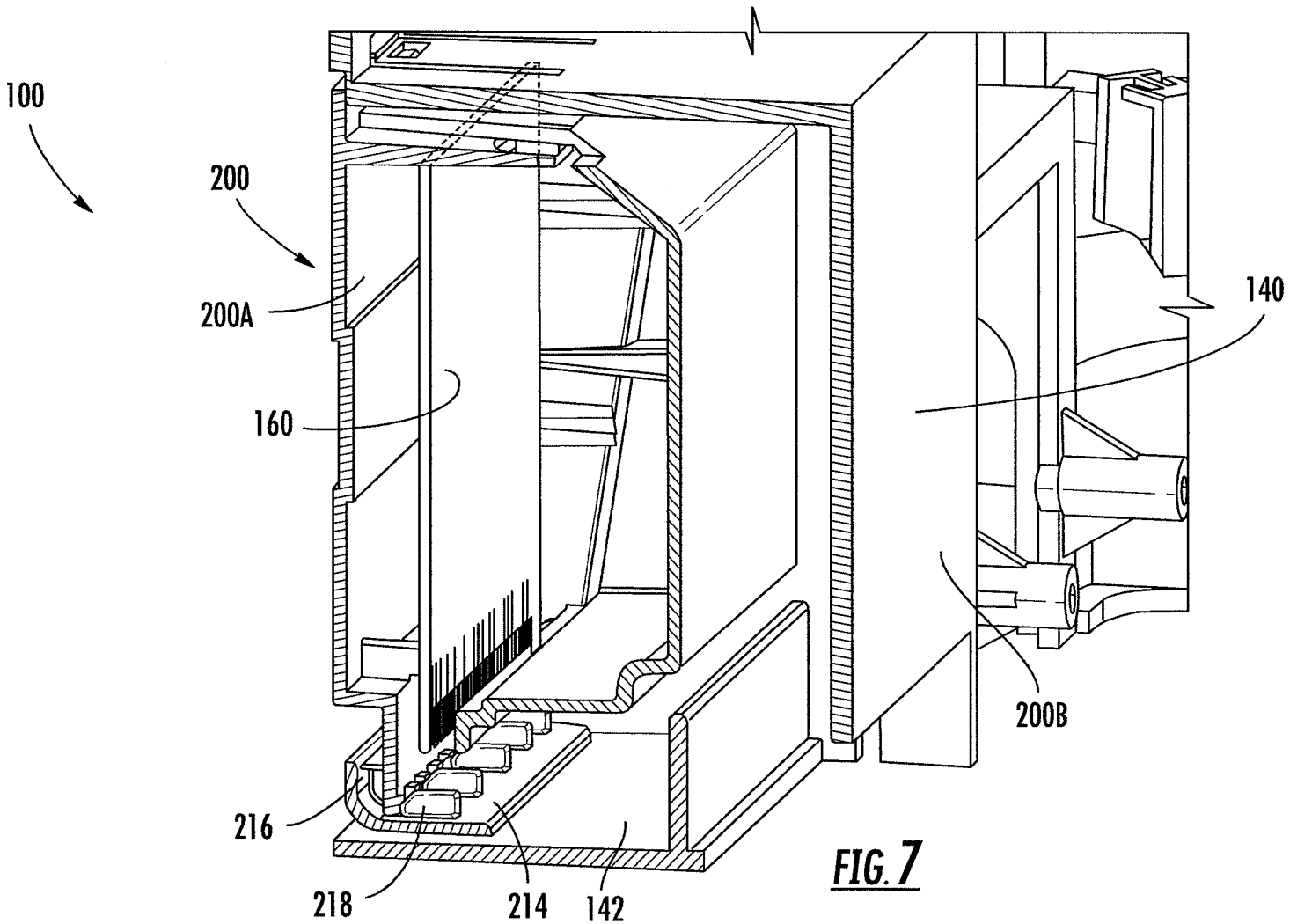
Figure 8:
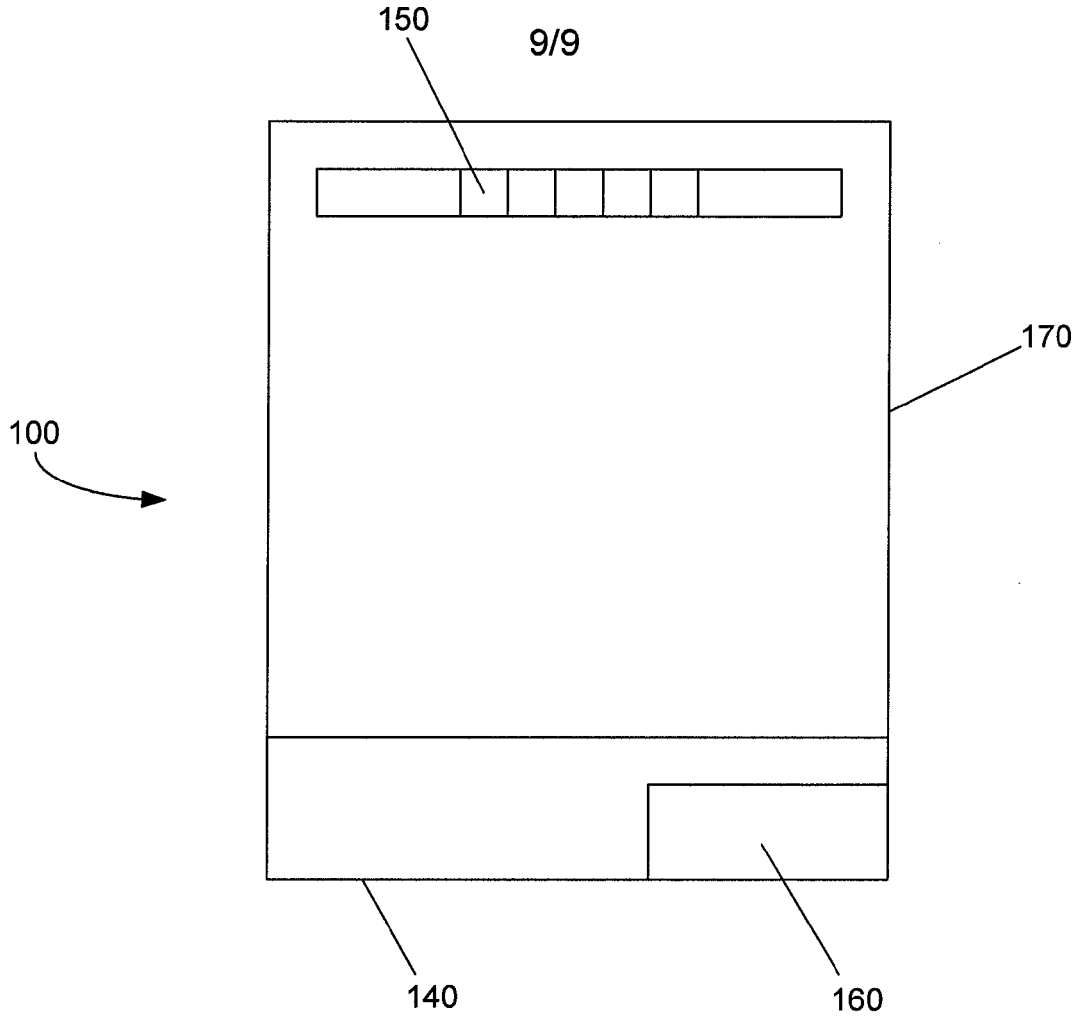

FIG. 4 schematically illustrates an exploded perspective of an accessible control unit having a barrier member associated therewith, according to one embodiment of the present invention;

FIG. 5A schematically illustrates a perspective front view of an accessible control unit having a barrier member associated therewith, according to one embodiment of the present invention;

FIG. 5B schematically illustrates a perspective rear view of an accessible control unit having a barrier member associated therewith, according to one embodiment of the present invention;

FIG. 6 is a perspective view of a dishwasher device having an accessible control unit with a barrier member associated therewith, with the control unit in a closed inaccessible position, according to the embodiment of the present invention shown in FIGS. 5A and 5B;

FIG. 7 is a cross-sectional side elevation view of a dishwasher device having an accessible control unit with a barrier member associated therewith, with the control unit in a closed inaccessible position, according to the embodiment of the present invention shown in FIGS. 5A and 5B; and FIG. 8 is a front view of a dishwasher including a dishwasher door, a control switch, and a control unit according to one embodiment of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

FIGS. 1, 2A, 2B, and 3 illustrate one embodiment of a dishwasher device according to the present invention, the dishwasher device being generally indicated by the numeral 100. Such a dishwasher device 100 generally comprises a tub 120 supported by a base 140, wherein both the tub 120 and the base 140 define respective forward ends, each adapted to face outwardly from any cabinet in which the dishwasher device 100 is installed. In some instances, the front end defines an access opening of the tub 120, through which dishware is loaded and unloaded with respect to the dishwasher device 100.

Such dishwasher devices 100 are typically electronically-controlled, implementing an electronic control unit 160 ("ECU") for interacting with various components (i.e., circulation pump, drain pump, water valve) of the dishwasher device 100 to control a dishwashing process. In such instances, the performed functions (i.e., wash, rinse, drain) or cycles (i.e., heated dry) may be selected by a user via one or more appropriate selector devices 150, such as one or more switches, buttons, knobs, or any combinations thereof. The selector devices 150 may be disposed remotely with respect to the ECU 160. For example, such selector devices 150 may be disposed about the upper end of the door 170 of the dishwasher device 100 for facilitating interaction therewith by a user, as shown in FIG. 8. However, the electrical supply from the house wiring to the dishwasher device 100 must also be engaged with designated electrical terminals of the dishwasher device 100, as well as with the ECU 160, before the dishwasher device 100 is installed.

Figure 1:
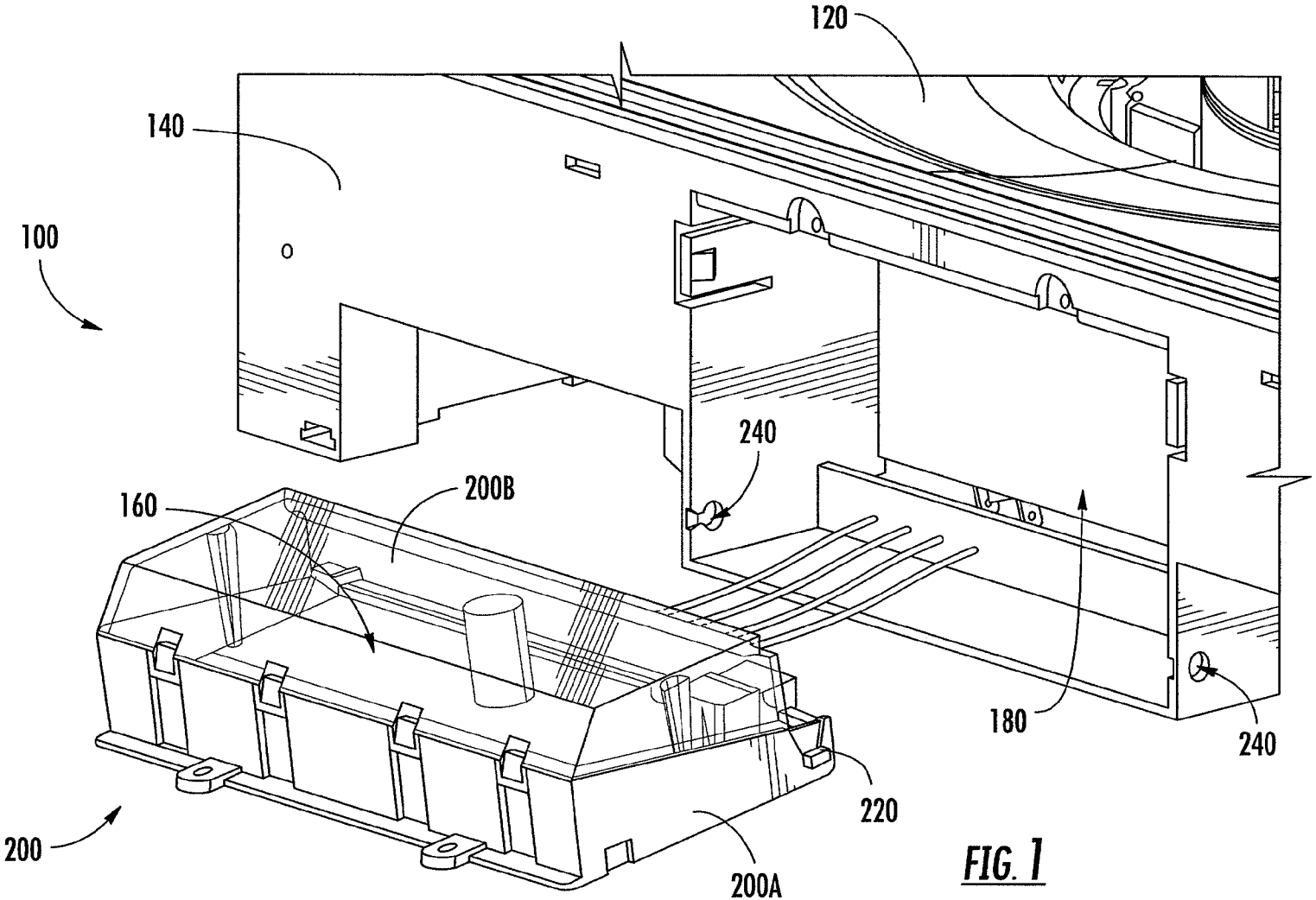

As such, in one aspect of the present invention, the base 140 is configured so as to define a compartment 180 about the forward end thereof, wherein the compartment 180 is configured to receive the ECU 160. With the compartment 180 disposed about the forward end of the base 140, the electrical supply from the house wiring, as well as the connections (i.e., wires) connecting the ECU 160 to the selector devices, may be directed through or connected to the compartment 180, as shown in FIG. 1. As such, the dishwasher device 100 may be installed, for example, within a cabinet structure, prior to the electrical connections to the dishwasher device 100 being established. However, in some instances, the electrical connections may be established elsewhere about the dishwasher device 100, and then appropriate power leads (i.e., wires) directed to or through the compartment 180. With the dishwasher device 100 being configured to receive the ECU 160 in the compartment 180 about the forward end of the base 140, the ECU 160 is readily accessible without requiring removal of the dishwasher device 100 from the cabinet, or extensive disassembly of the dishwasher device 100. In this manner, service, diagnosis, and/or replacement of the ECU 160 is facilitated.

The ECU 160 is mounted within a housing 200, which may be formed as one or more portions 200A, 200B configured to contain the ECU 160. For example, the housing 200 may be injection-molded in two complementary portions 200A, 200B of a thermoplastic material, wherein the ECU 160 is disposed in one portion 200A of the housing 200, and the other portion 200B of the housing 200 cooperates therewith to enclose the ECU 160. In such a manner, the ECU 160 is protected, for example, from water and dirt ingress. The housing 200 may further include provisions for allowing the wiring (i.e., a wiring harness) extending from or through the receptacle 180 to engage the ECU 160 within the housing 200. Once the ECU 160 is connected to the wiring, representing the electrical power connections, as well as the communication connections with the selector devices (i.e., both input and output connections), the housing 200 may be mounted within the compartment 180.

Figure 2A:
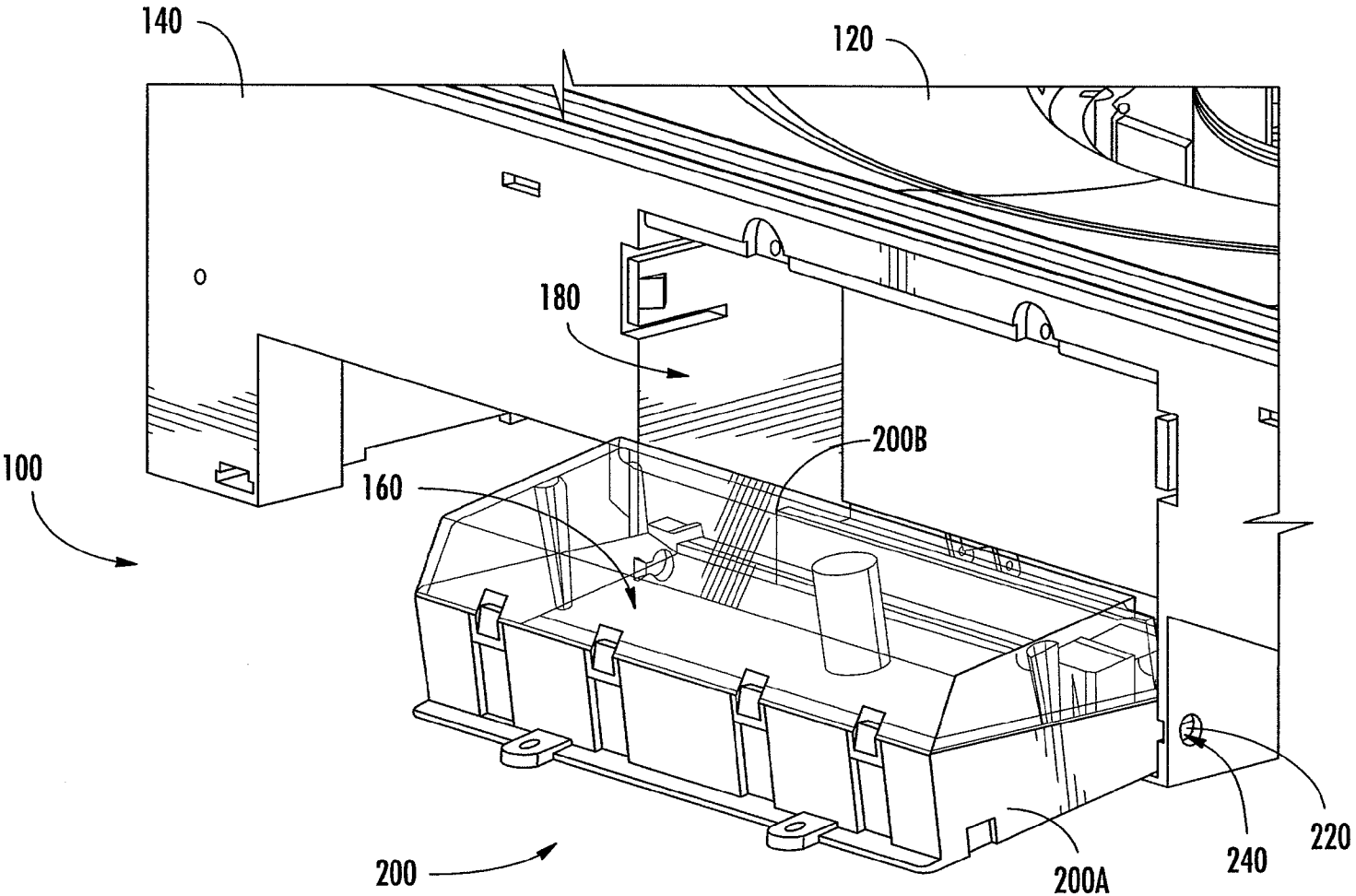
FIG. 2B is a side elevation of a dishwasher device having an accessible control unit, with the control unit in an open accessible position, according to the embodiment of the present invention shown in FIG. 2A.
Figure 2B:
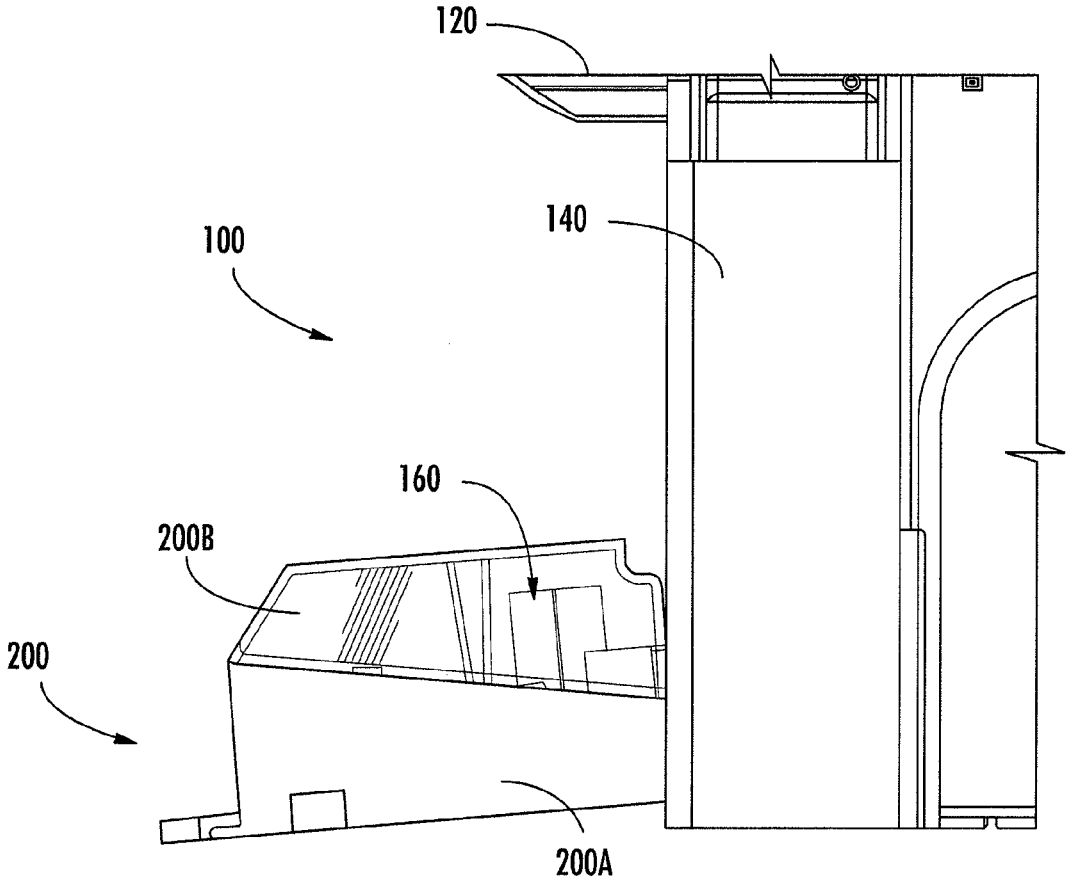
Figure 3:
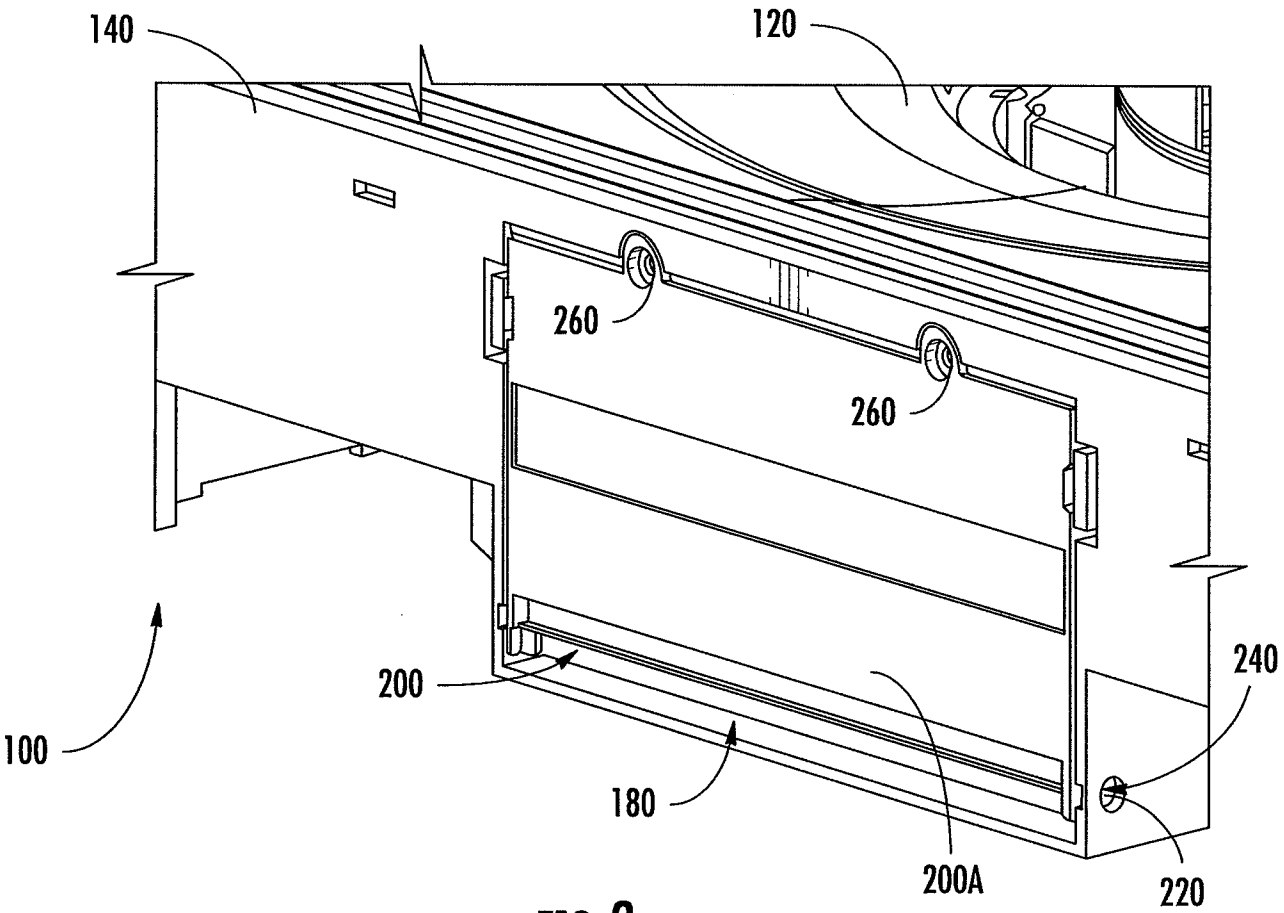
FIG. 3 is a perspective view of a dishwasher device having an accessible control unit, with the control unit in a closed inaccessible position, according to the embodiment of the present invention shown in FIG. 2A.

In one instance, opposing lateral ends of the housing 200 may have pins 220 extending therefrom, wherein the pins 220 are configured to engage complementary receptacles 240 defined by the lateral edges of the compartment 180. In this manner, the housing 200 becomes pivotably mounted with respect to the compartment 180 along a pivoting side of the housing 200. Further, in some instances, the ECU 160 may be disposed within the housing 200 such that a first electrical connector portion (not shown) operably engaged and associated with the ECU 160 is accessible through the pivoting side of the housing. When the housing 200 is so engaged with the compartment 180, a second electrical connector portion (not shown) can be engaged with or otherwise connected to the first electrical connector portion about the pivoting side of the housing 200 and any excess length of wire(s) extending to the housing 200 may be retracted into the base 140. Once assembled in such a manner, the housing 200 containing the ECU 160 is pivotable with respect to the compartment 180. As such, once engaged with the compartment 180 via the pins 220 and receptacles 240, the housing 200 becomes pivotable between an open accessible position (see, e.g., FIGS. 2A and 2B) and a closed inaccessible position (see, e.g., FIG. 3). Accordingly, in the open accessible position as shown in FIGS. 2A and 2B, one portion 200B of the housing 200 may be opened or removed so as to allow access to the ECU 160 therein for repair or replacement. Once the portion 200B of the housing 200 is replaced in a closed configuration containing the ECU 160, the housing 200 may be pivoted into a position whereby the housing 200 is substantially received within the compartment 180 and the ECU 160 is essentially inaccessible. The housing 200 in the inaccessible position may be secured with respect to the compartment 180 by appropriate fasteners 260, as shown in FIG. 3.

If access to the ECU 160 is required for service, diagnosis, and/or replacement, the fasteners 260 can be removed and the housing 200 pivoted outwardly of the compartment 180 to the accessible position (FIGS. 2A and 2B) such that the ECU 160 can be accessed. In such a manner, access to the ECU 160 is possible without disassembling or uninstalling the dishwasher device 100.

FIGS. 4, 5A, 5B, 6, and 7 illustrate another embodiment of dishwasher device 100 according to the present invention. In such embodiments, the ECU 160 (or control unit, control device, or circuit board) is mounted within a housing 200, which may be formed as one or more portions 200A, 200B configured to contain the ECU 160. For example, the housing 200 may be injection-molded in two complementary portions 200A, 200B of a thermoplastic material, wherein the ECU 160 is disposed in one portion 200A of the housing 200, and the other portion 200B of the housing 200 cooperates therewith to enclose the ECU 160. In such a manner, the ECU 160 is protected, for example, from water and dirt ingress. A barrier member 210 may be configured to operably engage the housing 200, for example, about the pivoting side thereof, and to extend at least partially along the pivoting side of the housing 200 such that at least a portion of the barrier member 210 is disposed between the housing 200 and the base 140. In this manner, the barrier member 210 may provide, for example, a flame barrier between the high voltage connectors (i.e., wiring) of the ECU 160 (control unit) and base 140, as may be needed, for example, in the event of a malfunction of the ECU 160.

In some instances, the barrier member 210 may be configured to "snap onto" or otherwise engage the housing 200, for example, the housing portion 200A, via engagement features 212 associated therewith, as shown in FIG. 5A. The barrier member 210 may be further adapted to be at least partially received within compartment 180 along with housing portions 200A and 200B, as shown in FIG. 6. FIG. 7 further shows that, according to some embodiments, the barrier member 210 may be configured to extend at least partially along the pivoting side of the housing 200 and have a first portion 214 configured to extend at least partially between the housing 200 and a bottom portion 142 of the base 140, when the housing 200 is mounted within compartment 180. As further shown in FIG. 7, a second portion 216 of the barrier member 210 may extend from the first portion 214 to engage the housing 200, for example, through engagement features 212.

In some instances, the barrier member 210 may be further configured, for instance, to further include or otherwise form at least one securement member for securing or holding a second electrical connector portion (not shown), extending from and associated with the electrical power connections, as well as the communication connections with the selector devices (i.e., both input and output connections), to the first electrical connector portion associated with the ECU 160. In this manner, the wiring harness/power wiring connectors may be retained in place relative to the ECU 160 (control unit) disposed within the housing 200. For example, one or more tab portions 218 may be configured to project from the barrier member 210 and to cooperate with the first portion 214 of the barrier member 210 to form the at least one securement member for retaining the wiring harness/power wiring connectors in place relative to the ECU 160 in housing 200.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A dishwasher, comprising:

a tub portion comprising an access opening adapted to receive dishware therein;

a door configured to cover the access opening and comprising at least one control switch device disposed at an upper end thereof;

a base portion adapted to support the tub portion; and an electronic control unit configured to be in communication with at least one dishwasher operational component and with the at least one control switch device, the at least one control switch device being remotely disposed with respect to the base portion and the electronic control unit, the electronic control unit being responsive to the at least one control switch device to control the at least one dishwasher operational component, and the electronic control unit being disposed about the base portion and selectively accessible, independently of the at least one control switch device, from a forward side thereof to facilitate service, diagnosis, and/or replacement of the electronic control unit.

2. A dishwasher according to claim 1, wherein the base portion is configured so as to define a compartment about the forward side thereof, the compartment being configured to receive the control unit.

3. The dishwasher according to claim 1, further comprising a housing configured to enclose the electronic control unit therein.

4. A dishwasher according to claim 3, wherein the base portion is configured so as to define a compartment at the forward side thereof, the compartment being configured to receive the housing having the control unit disposed therein.

5. A dishwasher according to claim 4, wherein the housing comprises first and second portions, the control unit being disposed in the first portion of the housing, and the second portion of the housing being configured to engage the first portion to enclose the control unit therebetween.

6. A dishwasher according to claim 4, wherein the housing is pivotably mounted with respect to the compartment such that the housing is pivotable between an open accessible position outwardly of the compartment and a closed inaccessible position within the compartment.

7. A dishwasher according to claim 6, wherein the housing comprises opposing lateral ends each configured to be coupled to the compartment such that each lateral end of the housing is pivotably mounted with respect to the compartment to define a pivoting side of the housing located between the lateral ends.

8. A dishwasher according to claim 7, wherein the control unit is disposed within the housing such that a first electrical connector portion associated with the control unit is accessible through the pivoting side of the housing.

9. A dishwasher according to claim 8, further comprising a barrier member configured to operably engage the housing and to extend along the pivoting side thereof between the lateral ends of the housing such that the barrier member is disposed between the housing and the base portion to provide a flame barrier therebetween.

10. A dishwasher according to claim 9, wherein the barrier member further comprises at least one securement member adapted to secure a second electrical connector portion in engagement with the first electrical connector portion associated with the control unit.

11. A dishwasher according to claim 9, wherein the barrier member comprises a first portion configured to extend between the housing and the base portion and within the compartment and a second portion extending from the first portion, the second portion comprising a plurality of engagement features configured to engage the housing outside of the compartment.

12. A method of making the product of claim 1, comprising the steps of:

engaging an electronic control unit about a base portion of the dishwasher, the base portion being adapted to support a tub portion comprising an access opening configured to receive dishware therein, such that the electronic control unit is selectively accessible from a forward side of the base portion to facilitate service, diagnosis, and/or replacement of the electronic control unit, the electronic control unit being configured to be in communication with at least one dishwasher operational component and with at least one control switch device, the at least one control switch device being disposed at an upper end of a door configured to cover the access opening and being remotely disposed with respect to the base portion and the electronic control unit, such that the electronic control unit is responsive to the at least one control switch device to control the at least one dishwasher operational component, the control unit being selectively accessible independently of the at least one control switch device.

13. A method of forming a dishwasher, comprising:

disposing an electronic control unit about a base portion of the dishwasher, the base portion being adapted to support a tub portion comprising an access opening configured to receive dishware therein, such that the electronic control unit is selectively accessible from a forward side of the base portion to facilitate service, diagnosis, and/or replacement of the electronic control unit, the electronic control unit being configured to be in communication with at least one dishwasher operational component and with at least one control switch device, the at least one control switch device being disposed at an upper end of a door configured to cover the access opening and being remotely disposed with respect to the base portion and the electronic control unit, such that the electronic control unit is responsive to the at least one control switch device to control the at least one dishwasher operational component, the electronic control unit being selectively accessible independently of the at least one control switch device.

14. A method according to claim 13, wherein disposing a control unit about a base portion of the dishwasher further comprises disposing the control unit within a compartment defined by the base portion about the forward side thereof, the compartment being configured to receive the control unit.

15. A method according to claim 13, wherein disposing a control unit about a base portion further comprises disposing the control unit within a housing configured to be received within a compartment defined by the base portion at the forward side thereof.

16. A method according to claim 15, wherein the housing comprises first and second portions, and disposing the control unit within a housing further comprises disposing the control unit in the first portion of the housing, and engaging the second portion of the housing with the first portion of the housing such that the first and second portions cooperate to enclose the control unit therebetween.

17. A method according to claim 15, wherein the housing is pivotably mounted with respect to the compartment, and the method further comprises pivoting the housing between an open accessible position outwardly of the compartment and a closed inaccessible position within the compartment.

18. A method according to claim 15, wherein the housing is pivotably mounted with respect to the compartment along a pivoting side of the housing and the method further comprises disposing the control unit within the housing such that a first electrical connector portion associated with the control unit is accessible through the pivoting side of the housing.

19. A method according to claim 18, further comprising operably engaging a barrier member with the housing such that the barrier member extends along the pivoting side thereof, and such that at least a portion of the barrier member is disposed between the housing and the base portion to provide a flame barrier therebetween.

20. A method according to claim 19, wherein the barrier member further comprises at least one securement member and operably engaging a barrier member with the housing further comprises engaging the barrier member with the housing such that the at least one securement member secures a second electrical connector portion in engagement with the first electrical connector portion associated with the control unit.

* * * * *